US008356504B2

(12) United States Patent
Koh et al.

(10) Patent No.: US 8,356,504 B2
(45) Date of Patent: Jan. 22, 2013

(54) ROLLING METHOD FOR A ROLLED PRODUCT FOR INTRODUCING A STEP INTO THE ROLLED PRODUCT

(75) Inventors: Edmund Koh, Singapore (SG); Dirk Krautwurst, Oberhausen (DE); Birger Schmidt, Brand-Erbisdorf (DE)

(73) Assignee: Siemens Aktiengesellschaft, München (DE)

( * ) Notice: Subject to any disclaimer, the term of this patent is extended or adjusted under 35 U.S.C. 154(b) by 1007 days.

(21) Appl. No.: 12/225,001

(22) PCT Filed: Feb. 8, 2007

(86) PCT No.: PCT/EP2007/051221

§ 371 (c)(1), (2), (4) Date: Feb. 18, 2009

(87) PCT Pub. No.: WO2007/104616

PCT Pub. Date: Sep. 20, 2007

(65) Prior Publication Data

US 2009/0306810 A1 Dec. 10, 2009

(30) Foreign Application Priority Data

Mar. 15, 2006 (DE) ..... 10 2006 011 939

(51) Int. Cl.
*B21B 31/20* (2006.01)

(52) U.S. Cl. ..... 72/240

(58) Field of Classification Search ..... 72/8.3, 72/8.8, 11.2, 11.5, 14.8, 14.9, 15.3, 15.4, 72/17.3, 18.1, 18.5, 240

See application file for complete search history.

(56) References Cited

U.S. PATENT DOCUMENTS

| | | | | |
|---|---|---|---|---|
| 4,248,072 | A * | 2/1981 | Hasegawa et al. | 72/8.3 |
| 4,793,169 | A * | 12/1988 | Ginzburg | 72/240 |

FOREIGN PATENT DOCUMENTS

| | | | | |
|---|---|---|---|---|
| DE | 2245650 | A1 | | 3/1973 |
| DE | 2930005 | A1 | | 6/1980 |
| EP | 1121990 | A2 | | 8/2001 |
| GB | 1401475 | A | | 7/1975 |
| JP | 60037201 | A | | 2/1985 |
| JP | 60106613 | A | * | 6/1985 |
| JP | 61103603 | A | | 5/1986 |
| JP | 61172603 | A | * | 8/1986 |
| JP | 1087007 | A | | 3/1989 |
| RU | 2001126868 | A | | 7/2003 |
| SU | 745548 | A1 | | 7/1980 |
| SU | 871957 | A1 | | 10/1981 |

* cited by examiner

*Primary Examiner* — Debra Sullivan

(57) ABSTRACT

The invention relates to rolled material comprising a front and an end. The rolled material is rolled in a roll gap of a roll stand to a first desired measurement, beginning at the front of the rolled material. When the rolled material is being rolled in the roll stand, it is continuously determined by a control computer, which locates the position of the rolled material which is currently in the roll gap. When the position of the rolled material, which is directly in the roll gap, corresponds to a predetermined first modification position of the rolled material, which is arranged between the front of the rolled material and the end of the rolled material, the roller of the rolled material ends at a first desired measurement such that a first step is introduced into the rolled material on the first modification point.

12 Claims, 4 Drawing Sheets

ROLLING METHOD FOR A ROLLED PRODUCT FOR INTRODUCING A STEP INTO THE ROLLED PRODUCT

CROSS REFERENCE TO RELATED APPLICATIONS

This application is the US National Stage of International Application No. PCT/EP2007/051221, filed Feb. 8, 2007 and claims the benefit thereof. The International Application claims the benefits of German application No. 10 2006 011 939.8 filed Mar. 15, 2006, both of the applications are incorporated by reference herein in their entirety.

FIELD OF INVENTION

The present invention relates to a rolling method for a rolled product, in particular a strip-type rolled product, which has a rolled product start and a rolled product end, the rolled product being rolled to a first desired dimension in a rolling gap of a rolling stand, starting with the start of the rolled product.

BACKGROUND OF THE INVENTION

The present invention also relates to a data medium with a computer program stored on the data medium, the computer program comprising machine code, the machine code bringing about the implementation of such a rolling method, when the machine code is executed by a control computer for a rolling stand. The present invention also relates to a control computer for a rolling stand, which is configured—in particular programmed—in such a manner that the rolling stand is activated by it according to such a rolling method. Finally the present invention relates to a rolled product, in particular a strip-type rolled product.

Rolling methods, data media, control computers and rolled products of the type mentioned in the introduction are generally known. In particular with the rolling methods of the type mentioned in the introduction the entire rolled product is rolled to the first desired dimension, in other words from the rolled product start to the rolled product end.

In some instances it would be expedient and useful to roll the rolled product to different desired dimensions, with the rolled product to be kept as a unit that is continuous per se.

In the prior art it is initially known that the entire rolled product can be rolled to a first desired dimension and the rolled product can then be divided, with one of the segments of the rolled product thus resulting being rolled to a second desired dimension. In this instance however the two segments of the rolled product are no longer continuous in respect of one another.

A rolling method is known from DE 22 45 650 A1, wherein, while the rolled product is being rolled in the rolling stand, a control computer determines in an ongoing manner which point of the rolled product is currently in the rolling gap and rolling of the rolled product to the first desired dimension is terminated, when the point of the rolled product currently in the rolling gap corresponds to a previously determined first change point of the rolled product, which is located between the start of the rolled product and the end of the rolled product. Once the first change point has been reached, the rolling process is reversed, so that the rolled product passes through the rolling stand backward after reaching the first change point. The rolling gap of the rolling stand is not changed in this process, so the reverse pass is executed as a smoothing pass.

A similar disclosure can be found in JP 60 037 201 A.

A rolling method is known from JP 01 087 007 A, wherein a slope is introduced into the rolled product in a predetermined change region.

A metal sheet is known from the specialist article "Visionen und innovative Lösungen in der Umformtechnik" (Visions and innovative solutions in metal working) by Dorothea Velikonja, Stahl und Eisen 124 (2004), no. 8, pages 36 to 38, which has regions of differing thickness when viewed in a longitudinal direction. A similar disclosure can be found in the specialist article "Belastunsangepasste Bleche durch Flexibles Walzen" (Metal sheets adapted to loading by flexible rolling) by Reiner Kopp and Andreas Hauger, VDI-Z Special Blechbearbeitung, October 98, pages 50 to 53.

A rolling method is known from EP 1 121 990 A2, by means of which strips can be produced with periodically changeable strip thickness.

SUMMARY OF INVENTION

The object of the present invention is to create a rolling method, a data medium and a control computer for a rolling stand, which can be used to produce a rolled product, which is configured as continuous per se and has at least two segments in the longitudinal direction, said segments having different dimensions from one another, it being possible to carry out the rolling method regardless of whether the rolling gap can only be adjusted in the load-free state or also under load.

The object is achieved for the rolling method in that the rolling stand is raised when the point of the rolled product currently in the rolling gap corresponds to the first change point, so that a first step is introduced into the rolled product at the first change point and the rolled product passes through the rolling gap without being worked after the rolling stand has been raised.

In a corresponding manner the object for the data medium is achieved in that it stores a computer program, which serves to implement such a rolling method, when the computer program is executed by a control computer for a rolling stand.

Finally the object is achieved by a control computer for a rolling stand, which is configured, in particular programmed, in such a manner that the rolling stand can be activated by it according to such a rolling method.

The passage of the rolled product through the—then raised—rolling stand without being worked can take place either forward (in other words in the previous rolling direction) or backward.

When the passage takes place backward without working, it is possible for the rolled product, after rolling to the first desired dimension, starting with the start of the rolled product, to be rolled to a third desired dimension in the rolling gap of the rolling stand, until the point of the rolled product currently in the rolling gap corresponds to a second change point.

The second change point can be located between the start of the rolled product and the first change point, so that a second step is introduced into the rolled product at the second change point. The second change point can also correspond to the first change point, so that the first step is increased.

In contrast, when the rolled product has passed in its entirety through the rolling stand, it is possible for the rolled product then to be rolled to a second desired dimension, starting with the end of the rolled product, until the point currently in the rolling gap corresponds to a second change point, which is located between the first change point and the end of the rolled product, so that a second step is introduced into the rolled product at the second change point. Rolling to the second dimension is of course also terminated at the second change point in this instance.

BRIEF DESCRIPTION OF THE DRAWINGS

Further advantages and details will emerge from the description which follows of exemplary embodiments in conjunction with the basic outlines in the drawings, in which.

DETAILED DESCRIPTION OF INVENTION

Figure 1:
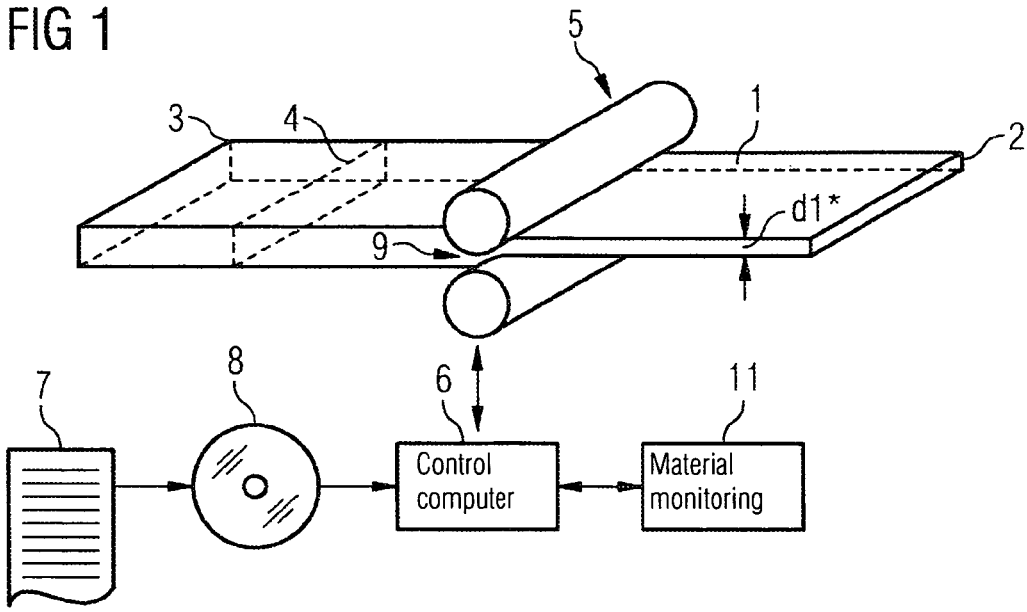
FIG. 1 shows the basic structure of a rolling arrangement.

According to FIG. 1 a rolled product 1 is to be rolled. The rolled product 1 here is preferably a strip-type rolled product 1. However a rod-type rolled product or a tubular rolled product could also be rolled.

The rolled product 1 has a rolled product start 2 and a rolled product end 3. Also at least one change point 4—also referred to below as the first change point 4—is predefined.

The change point 4 is preferably not defined by its distance from the rolled product start 2 or the rolled product end 3, since this distance changes as the rolled product 1 is rolled. Rather the change point 4 is preferably determined by the quantity of material of the rolled product 1 between the change point 4 and the rolled product start 2 or the rolled product end 3.

The rolled product 1 is rolled in a rolling stand 5. For its part the rolling stand 5 is controlled by a control computer 6. A computer program 7 is supplied to the control computer 6. The computer program 7 can be supplied for example by means of a portable or otherwise data medium 8, on which the computer program 7 is stored in (exclusively) machine-readable form. Supplying the computer program 7 programs (or more generally configures) the control computer 6 in such a manner that it executes a rolling method, which is described below in conjunction with FIGS. 2 to 14.

Figure 2:
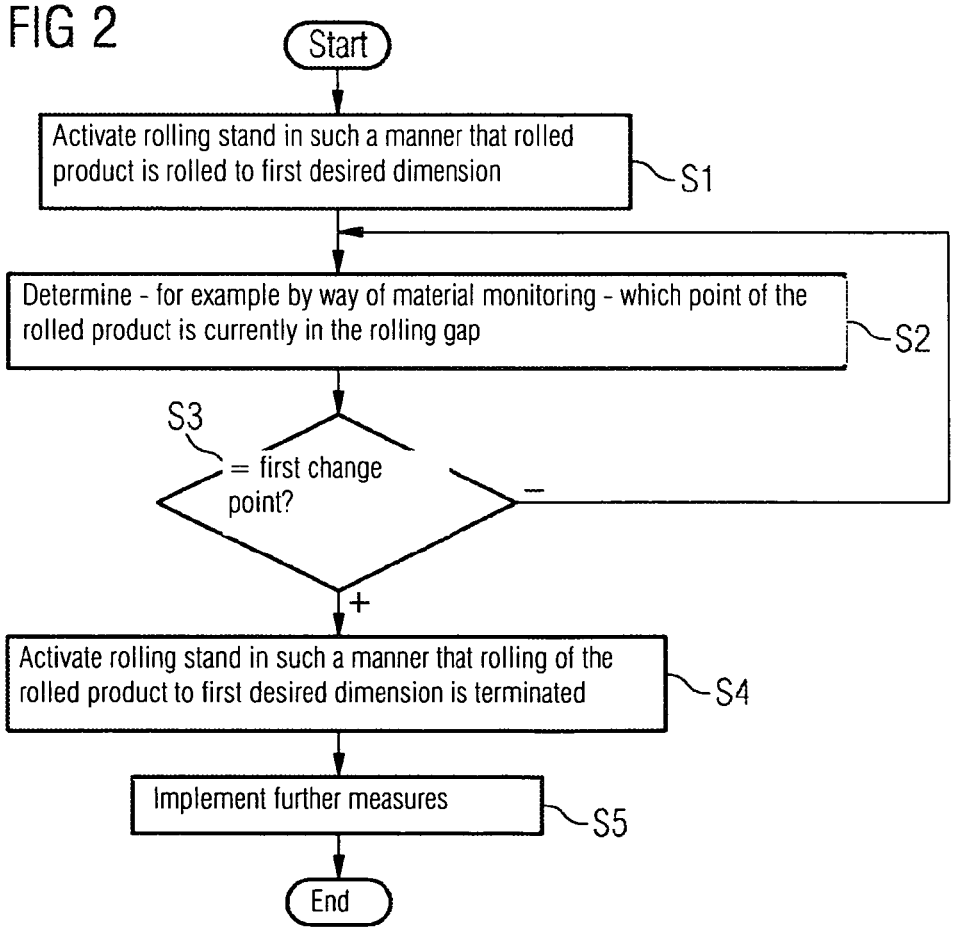
FIG. 2 shows a flow diagram.
Figure 3:
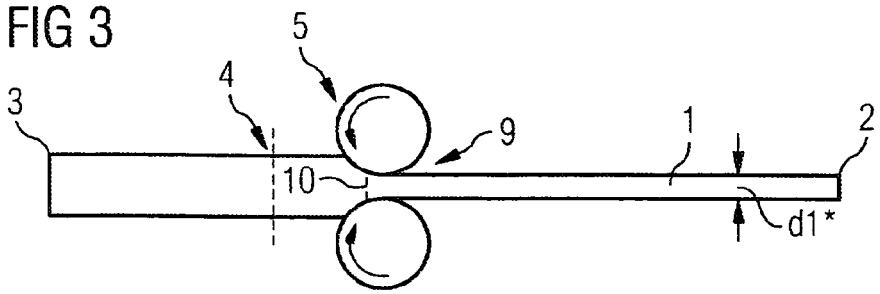
FIGS. 3 to 14 show different states during the rolling of a rolled product and FIG. 15 shows a rolled product after rolling.

According to FIG. 2 in a step S1 the control computer 6 activates the rolling stand 5 in such a manner that the rolled product 1 is rolled to a first desired dimension d1* (in the case of a strip-type rolled product 1 therefore to a first desired thickness d1*) from the rolled product start 2. Determination of the necessary control parameters for the rolling stand 5 by means of a pass schedule and the stand parameters of the rolling stand 5 is generally know to those skilled in the art. The actual rolling process, in other words the working of the rolled product 1, takes place in a rolling gap 9 of the rolling stand 5.

In a step S2 the control computer 6 determines which point 10 of the rolled product 1 is currently in the rolling gap 9. The point 10 can be determined for example by way of a generally known material monitoring system 11.

In a step S3 the control computer 6 compares the point 10 determined in step S2 with the first change point 4. If the first change point 4 has not yet been reached—see for example FIG. 3—the control computer 6 returns to step S2. This return to step S2 on the one hand causes the rolling process, which was started in step S1, to be continued. On the other hand step S2 is executed again, so that as a result the control computer 6 determines in an ongoing manner while the rolled product 1 is being rolled in the rolling stand 5 which point of the rolled product 1 is currently in the rolling gap 9.

Figure 4:
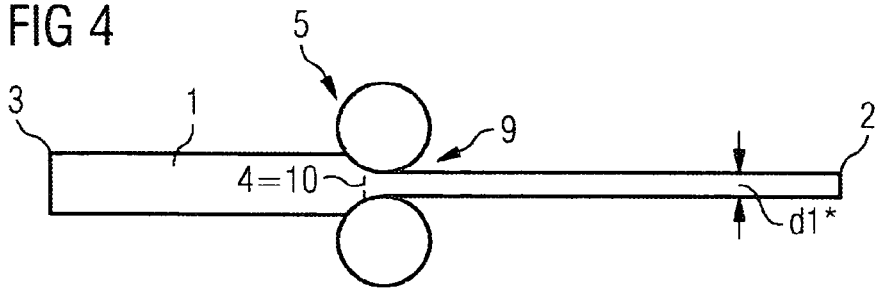
Figure 5:
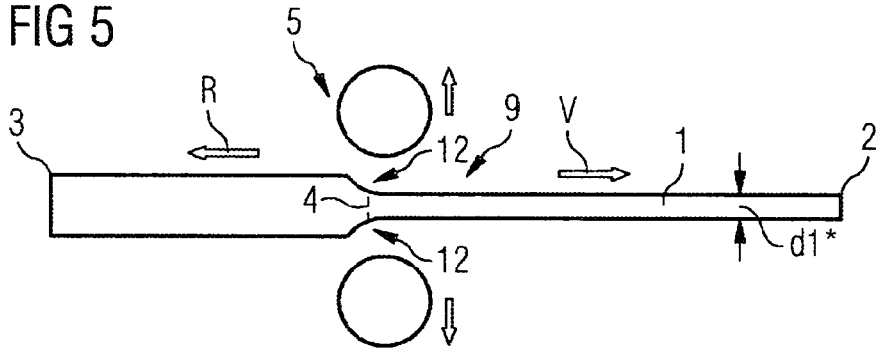
Figure 6:
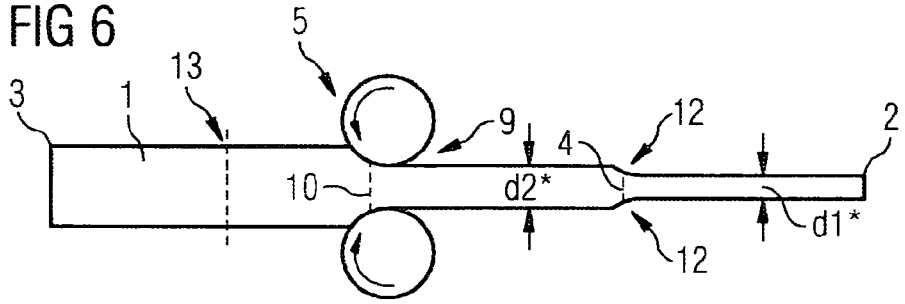
Figure 7:
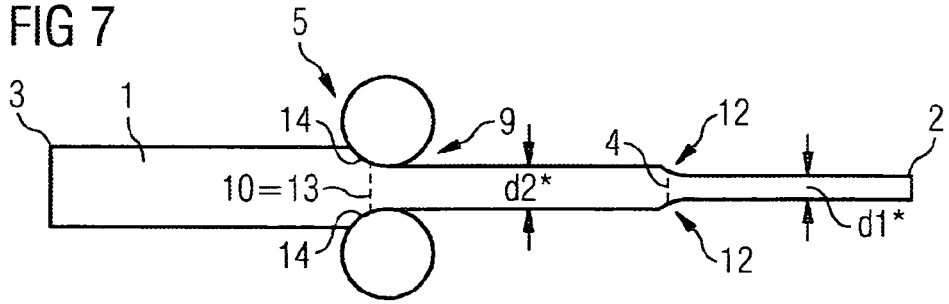
Figure 8:
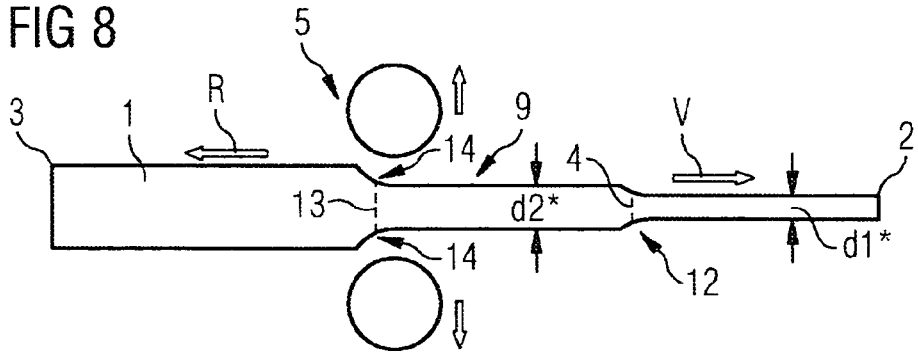
Figure 9:
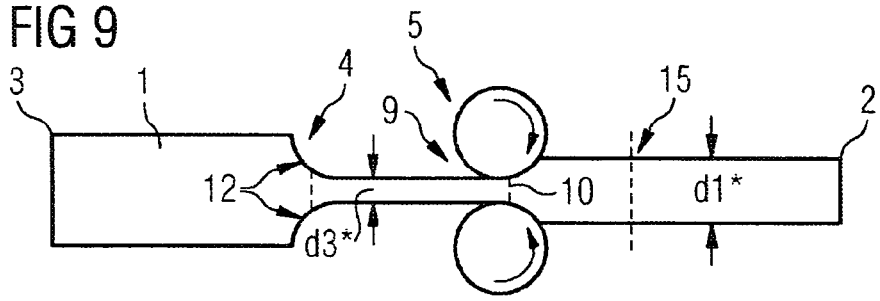

If however the first change point 4 has been reached—see FIG. 4—in a step S4 the control computer terminates rolling of the rolled product 1 to the first desired dimension d1* by corresponding activation of the rolling stand 5. Regardless of further measures, which are implemented in a step S5 and which are set out in further detail below, this introduces a first step 12 into the rolled product 1 at the first change point 4.

The further measures of step S5 can vary in nature. In the simplest instance—see FIG. 5—the rolling stand 5 is raised (naturally due to corresponding activation by the control computer 6), when the point 10 currently in the rolling gap 9 corresponds to the first change point 4. Raising the rolling stand 5 has the advantage that it can also be done by means of control elements, which can only be displaced when load-free. The rolled product 1 is then removed forward (see arrow V) or backward (see arrow R) from the rolling stand 5. Because the rolling stand 5 is raised, the rolled product 1 therefore passes through the rolling gap 9 without being worked.

It is however also possible for rolling per se to continue after the termination of rolling to the first desired dimension d1*. In contrast to the simple raising of the rolling stand 5 in this instance it is necessary for it to be possible to displace the control elements under load. In this instance for example—see FIG. 6—the rolling stand 5 can be set by the control computer 6 to a new (second) desired dimension d2* and the rolled product 1 can be rolled to the second desired dimension d2* in the direction of the rolled product end 3 after reaching the first change point 4.

The second desired dimension d2* can be smaller than the first desired dimension d1*. It is preferably greater than the first desired dimension d1*, since it is then possible to set to the second desired dimension d2* more rapidly.

If rolling continues, it is possible for the rolled product 1 to be rolled to the second desired dimension d2* until the rolled product 1 has been rolled in its entirety, in other words the rolled product end 3 has passed through the rolling gap 9. It is however also possible—see FIG. 7—for rolling of the rolled product 1 to the second desired dimension d2* to be terminated, when the point 10 of the rolled product 1 currently in the rolling gap 9 corresponds to a previously determined second change point 13, which is located between the first change point 4 and the rolled product end 3. In this instance a second step 14 is introduced into the rolled product 1 at the second change point 13.

The procedure for introducing the second step 14 at the second change point 14 is similar in every respect to the introduction of the first step 12 at the first change point 4. There is therefore no need for a detailed explanation here. Also the measures implemented after the introduction of the second step 14 are similar in every respect to the measures implemented after the introduction of the first step 12 at the first change point 4. In particular the rolling stand 5 can be raised—see FIG. 8—the rolling process being continued with a further desired dimension, etc.

If the rolling gap 9 can be adjusted under load, it is also possible—starting from the state illustrated in FIG. 4—in the context of step S5 to continue the rolling process after the first change point 4 has been reached, but with the rolled product 1 being rolled in the direction of the rolled product start 2. In this instance the rolled product 1 is rolled to a second desired dimension d3*, the second desired dimension d3*—see FIG. 9—being smaller than the first desired dimension d1*.

Theoretically it is possible for the rolled product 1 only to be rolled further from a point which is located between the first change point 4 and the rolled product start 2. However generally rolling to the second desired dimension d3* starts directly at the first change point 4.

Figure 10:
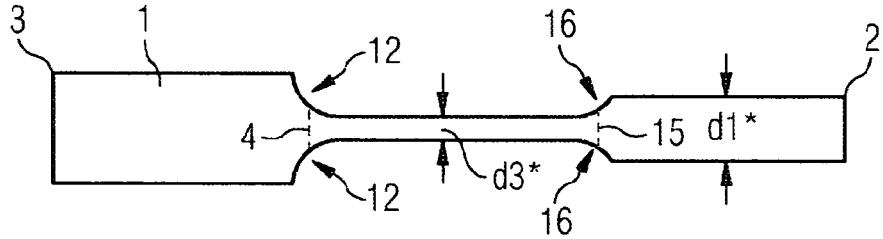

It is also possible for rolling of the rolled product 1 to the second desired dimension d3* to be terminated, when the point 10 of the rolled product 1 currently in the rolling gap 9 corresponds to a previously determined second change point 15. In this instance the second change point 15 is located between the rolled product start 2 and the first change point 4. In this instance a second step 16 is introduced into the rolled product 1 at the second change point 15. This is shown in FIG. 10. Generally however the rolled product 1 is rolled to the second desired dimension d3* to the rolled product start 2. This state is shown in FIG. 11.

Even if it is in principle possible to continue rolling from the first change point 4, the rolling stand 5 is generally raised, so that the rolled product 1 passes through the rolling gap 9 without being worked from the first change point 4. This procedure has the advantage that it can be carried out regardless of whether the rolling gap 9 can only be set in the load-free state or also under load. Regardless of this however the rolled product 1 has either passed through the rolling gap 9 in its entirety at some point (in other words to the rolled product end 3) or the rolled product 1 has been drawn back in its entirety from the rolling gap 9 (in other words up to the rolled product start 2). Both these instances are examined further below.

Figure 12:
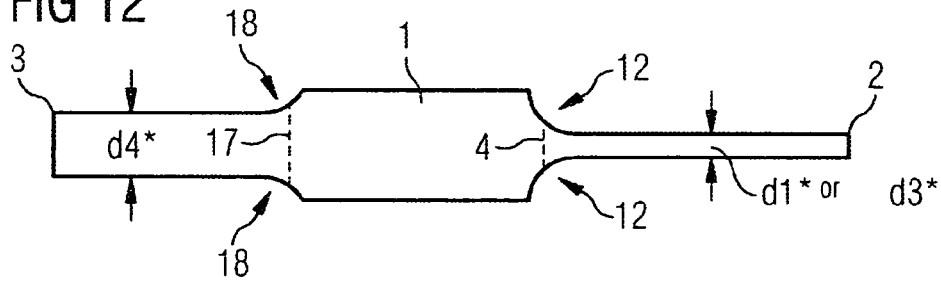

When the rolled product 1 has passed through the rolling gap 9 in its entirety (in other words to the rolled product end 3) it is possible, starting with the rolled product end 3, to roll the rolled product 1 to a second desired dimension d4*, until the point 10 currently in the rolling gap 9 corresponds to a second change point 17, which is located between the first change point 4 and the rolled product end 3. In this instance a second step 18 is introduced into the rolled product 1 at the second change point 17. The procedure is similar in every respect to the introduction of the first step 12 at the first change point 4, so there is no need for a detailed explanation of the procedure. The rolled product 1 with the second step 18 introduced therein is shown in FIG. 12. In some instances more than one step can be introduced into the rolled product 1 in this pass too.

Figure 11:
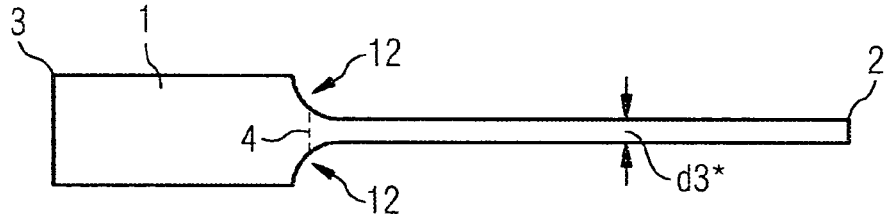

When the rolled product 1 has been drawn back in its entirety from the rolling gap 9, in other words up to and including the rolled product start 2, it is possible to roll the rolled product 1 to a third desired dimension d5* after rolling to the first desired dimension d1* or—in the case of the embodiment in FIG. 11 after rolling to the second desired dimension d3*. In this instance the rolling process starts with the rolled product start 2 and is executed until the point 10 of the rolled product 1 currently in the rolling gap 9 corresponds to a second change point 19.

Figure 13:
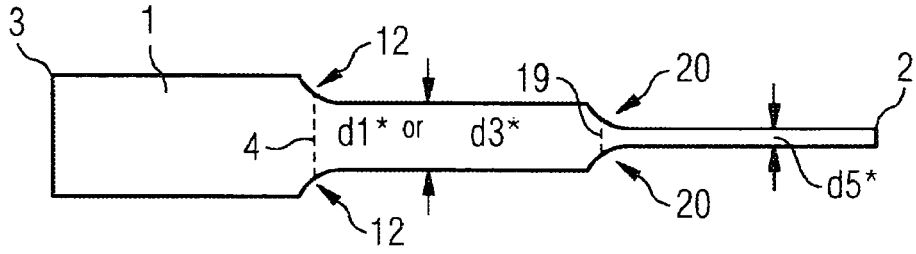
Figure 14:
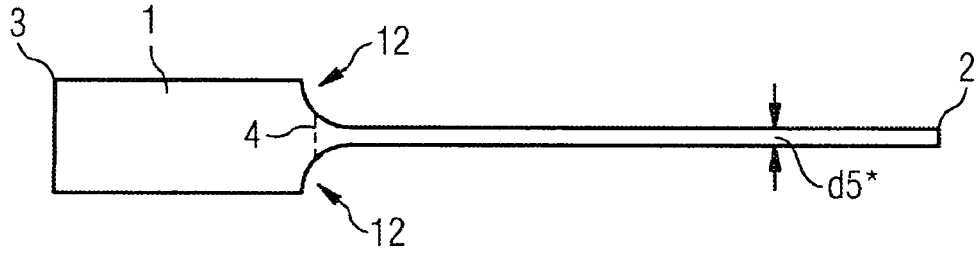

It is possible—see FIG. 13—for the second change point 19 to be located between the rolled product start 2 and the first change point 4. In this instance a second, additional step 20 is introduced into the rolled product 1 at the second change point 19. It is however also possible for the second change point 19 to correspond to the first change point 4. In this instance the first step 12 is increased—see FIG. 14.

Figure 15:
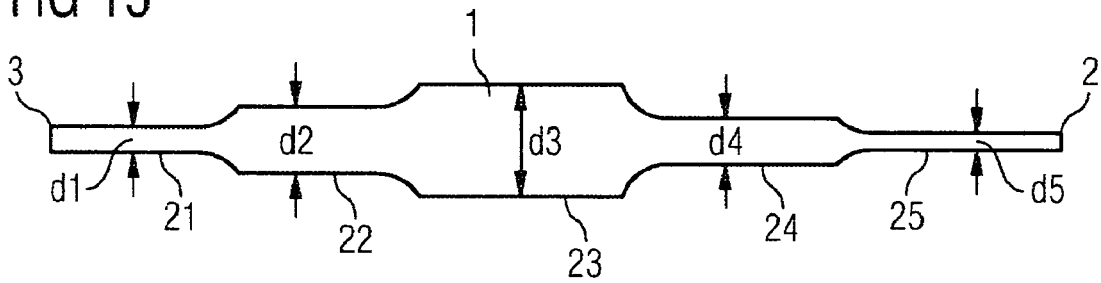

It is thus possible by means of the procedures described above to produce a rolled product 1 in a simple manner, said rolled product 1 having a number of segments 21 to 25 according to FIG. 15, which have differing dimensions d1 to d5 from one another. It is in particular possible to produce the rolled product 1 shown in FIG. 15 even if the rolling stand 5 has control facilities for setting the rolling gap 9 that can only be adjusted in the load-free state, in other words not under load. The procedures described above can hereby be combined with one another in almost any manner.

The invention claimed is:

1. A rolling method for producing a strip-type rolled product which has a rolled product start and a rolled product end, comprising:

rolling the product to a first desired dimension in a rolling gap of a rolling stand, starting with the rolled product start;

determining in an ongoing manner by a control computer which point of the rolled product is currently in the rolling gap, while the rolled product is being rolled in the rolling stand; and terminating rolling the rolled product to the first desired dimension and raising the rolling stand when the point of the rolled product currently in the rolling gap corresponds to a previously determined first change point of the rolled product, which is located between the rolled product start and the rolled product end, such that a first step is introduced into the rolled product at the first change point and the rolled product passes through the rolling gap without being worked after the rolling stand has been raised, wherein, when the rolled product has passed through the rolling gap to the rolled product end, starting with the rolled product end, the rolled product is rolled to a second desired dimension, until the point currently in the rolling gap corresponds to a second change point, which is located between the first change point and the rolled product end.

2. The rolling method as claimed in claim 1, wherein the rolled product is rolled to a third desired dimension in the rolling gap of the rolling stand starting with the rolled product start, until the point of the rolled product currently in the rolling gap corresponds to a third change point.

3. The rolling method as claimed in claim 2, wherein the third change point is located between the rolled product start and the first change point such that a second step is introduced into the rolled product at the third change point.

4. The rolling method as claimed in claim 2, wherein the third change point corresponds to the first change point so the first step is increased.

5. A data storage device, comprising:

a data storage medium; and a computer machine code stored on the storage medium for execution via a computer comprising:

starting a rolling of a rolled product to a first desired dimension in a rolling gap of a rolling stand, wherein the rolled product includes a rolled product start and a rolled product end, determining in an ongoing manner which point of the rolled product is currently in the rolling gap, while the rolled product is being rolled in the rolling stand, and terminating rolling the rolled product to the first desired dimension and raising the rolling stand when the point of the rolled product currently in the rolling gap corresponds to a previously determined first change point of the rolled product, which is located between the rolled product start and the rolled product end, such that a first step is introduced into the rolled product at the first change point and the rolled product passes through the rolling gap without being worked after the rolling stand has been raised, wherein, when the rolled product has passed through the rolling gap to the rolled product end, starting with the rolled product end, the rolled product is rolled to a second desired dimension, until the point currently in the rolling gap corresponds to a second change point, which is located between the first change point and the rolled product end.

6. The data storage device as claimed in claim 5, wherein the rolled product is rolled to a third desired dimension in the rolling gap of the rolling stand starting with the rolled product start, until the point of the rolled product currently in the rolling gap corresponds to a third change point.

7. The data storage device as claimed in claim 6, wherein the third change point is located between the rolled product start and the first change point such that a second step is introduced into the rolled product at the third change point.

8. The data storage device as claimed in claim 6, wherein the third change point corresponds to the first change point so the first step is increased.

9. A control computer for controlling a rolling stand, comprising:

a processing unit;

a data storage device; and a computer machine code stored on the storage device for execution via the computer comprising:

starting a rolling of a rolled product to a first desired dimension in a rolling gap of a rolling stand, wherein the rolled product includes a rolled product start and a rolled product end, determining in an ongoing manner which point of the rolled product is currently in the rolling gap, while the rolled product is being rolled in the rolling stand, and terminating rolling the rolled product to the first desired dimension and raising the rolling stand when the point of the rolled product currently in the rolling gap corresponds to a previously determined first change point of the rolled product, which is located between the rolled product start and the rolled product end, such that a first step is introduced into the rolled product at the first change point and the rolled product passes through the rolling gap without being worked after the rolling stand has been raised, wherein, when the rolled product has passed through the rolling gap to the rolled product end, starting with the rolled product end, the rolled product is rolled to a second desired dimension, until the point currently in the rolling gap corresponds to a second chance point, which is located between the first change point and the rolled product end.

10. The control computer as claimed in claim 9, wherein the rolled product is rolled to a third desired dimension in the rolling gap of the rolling stand starting with the rolled product start, until the point of the rolled product currently in the rolling gap corresponds to a third change point.

11. The control computer as claimed in claim 10, wherein the third change point is located between the rolled product start and the first change point such that a second step is introduced into the rolled product at the third change point.

12. The control computer as claimed in claim 10, wherein the third change point corresponds to the first change point so the first step is increased.

* * * * *